United States Patent [19]

Kurokawa

[11] Patent Number: 4,875,958

[45] Date of Patent: Oct. 24, 1989

[54] METHOD OF MAKING MOLDED SANITARYWARE ARTICLES WITH LIGHT TRANSMITTING PANEL

[75] Inventor: Masayuki Kurokawa, Tokyo, Japan

[73] Assignee: American Standard Inc., New York, N.Y.

[21] Appl. No.: 155,407

[22] Filed: Feb. 12, 1988

Related U.S. Application Data

[62] Division of Ser. No. 5,814, Jan. 21, 1987, abandoned.

[30] Foreign Application Priority Data

Jan. 23, 1986 [GB] United Kingdom ..... 8601617

[51] Int. Cl.[4] ..... B32B 31/04; B05D 1/32

[52] U.S. Cl. ..... 156/108; 156/278; 427/259; 427/272; 4/546; 264/132; 264/257; 264/571

[58] Field of Search ..... 264/129, 245, 257, 101, 264/571, 132; 427/259, 272; 4/546; 156/108, 278

[56] References Cited

U.S. PATENT DOCUMENTS

| | | | |
|---|---|---|---|
| 2,695,256 | 11/1954 | Olloqui | 264/257 |
| 3,359,352 | 12/1967 | Powell | 264/132 |
| 3,596,317 | 8/1971 | Nicholson | 425/407 |
| 4,209,486 | 6/1980 | Ross | 264/245 |
| 4,293,603 | 10/1981 | Hayman-Choffey | 264/129 |
| 4,364,132 | 12/1982 | Robinson | 4/456 |
| 4,477,486 | 10/1984 | Boaz | 427/259 |
| 4,535,489 | 8/1985 | Elkins | 4/456 |
| 4,644,630 | 2/1987 | Blum | 264/132 |
| 4,702,942 | 10/1987 | Wood | 427/259 |

FOREIGN PATENT DOCUMENTS 0034678 9/1981 European Pat. Off. .

*Primary Examiner*—Jay H. Woo
*Assistant Examiner*—Jeremiah F. Durkin, II
*Attorney, Agent, or Firm*—John P. Sinnott

[57] ABSTRACT

A method of making a sanitaryware article with a light transmitting panel. A sheet of light-transmitting plastic is formed into the shape of a article of sanitaryware which has a sump. A mask is applied to a portion of the plastic sheet and the remaining portions are covered with a coating which makes the areas opaque. The mask is removed and a rigid panel of a light transmitting plastic is bonded to the light transmitting area of the shell.

7 Claims, 10 Drawing Sheets

METHOD OF MAKING MOLDED SANITARYWARE ARTICLES WITH LIGHT TRANSMITTING PANEL

This application is a division of application Ser. No. 005,814, filed 1/21/87 now abandoned.

BACKGROUND OF THE DISCLOSURE

1. Field of the Invention

This invention relates to molded sanitaryware articles, particularly although not exclusively domestic baths, to a method of manufacturing such articles, and to a bath or other molded article installation.

2. Description of Prior Art

Baths were traditionally made of cast iron but, in recent times, they have also been made of pressed steel and of various types of plastics or resin material, including glass fiber reinforced plastic (GRP) and acrylic material. In the latter cases, the article is built up on a mold former or is shaped by using a vacuum-forming technique. Other molded products have been made in similar ways, for example, shower trays, washbasins and bath panels. In all such cases, the material of the finished articles forming the walls, bottom and other surfaces have been opaque, or effectively opaque in use of the article.

It has been proposed to incorporate in a composite wall, a bath or other molded article, a decorative layer applied to a coating which is itself applied to a mold, and then covering the decorative layer with a second coating, at least one of the coatings being transparent or translucent so as to obtain a decorative effect. In practice, such a construction would need to be reinforced with a further backing layer which is normally near to being opaque.

SUMMARY OF THE INVENTION

According to a first aspect of the present invention, there is provided a molded sanitaryware article made of plastics sheet material in which the wall or walls of the article include one or more areas which are transparent or translucent, the remainder being opaque.

The molded article may be in the form of a container, such as a bath or shower tray, with side walls and a bottom wall, and possibly a top rim or roll and outer side walls, in which case one or both transparent or translucent are as may be in any of such walls. Alternatively, the molded article could be a sanitaryware component, such as a bath panel, the area or areas of translucent or transparent material being incorporated in the wall of the article.

In a preferred embodiment, the molded article comprises a bath with one or more clear or translucent panels in the bottom wall or base of the bath.

According to a further aspect of the invention, there is provided a sanitaryware installation comprising a molded article, there being in one or more walls of the article, an area or areas of light-transmitting material surrounded by areas of non-light-transmitting material, and one or more lighting elements located behind or adjacent the light-transmitting areas, such that light is transmitted through one or both light-transmitting areas so as to be visible in the finished article.

If the article is a bath or shower tray, for example, the lighting elements would be underneath or behind the sides of the article or, if a bath panel, behind that panel.

For a bath, a difficult area to provide the light-transmitting area or areas is in the base of the bath because baths are normally supported on the base and, also, the base must be strong.

According to a still further aspect of the invention, therefore, a method is provided for making a molded article comprising the steps of forming a translucent or transparent shell, applying a mask to an area intended in the finishing article to form a light-transmitting area, coating the remaining shell area to make it effectively opaque and removing the mask.

Advantageously, the area from which the mask is removed may have a panel of clear or translucent plastics overlying or underlying it. The panel may be bonded to the translucent or transparent area with clear cement, or it may be bonded to the edges around that area, or simply secured in position by other suitable means.

Preferably, the panel of clear or translucent plastics is a relatively thick layer and overhangs the edges of the previously masked, light-transmitting area.

The article so produced may, if required, be reinforced over its non-light-transmitting area with suitable reinforcing material, or it may be reinforced over its entire surface, including one or both light transmitting areas or panels, if a suitable light-transmitting reinforcement material is used.

One or both light-transmitting areas or panels may, of course, be colored or white and/or patterned, as may be the opaque remainder of the article. Colored light may also be used in an installation.

Where a molded article is double skinned with a space between the skins, it is conceivable to provide one or more light-transmitting areas or panels in the inner or outer skin only, for example, by hidden lighting elements or light-emitting panels behind the light-transmitting areas or panels.

The lighting elements may be fluorescent tubes, spotlights or any other suitable light source such as light-emitting panels powered independently or by secondary energy such as solar panels or fluorescent or other luminescent material. The lighting elements need not, however, be such primary sources but could be secondary, such as mirror elements using reflected light which has passed through the translucent or transparent area and is then reflected back again.

DETAILED DESCRIPTION OF THE PREFERRED EMBODIMENT

Figure 1:
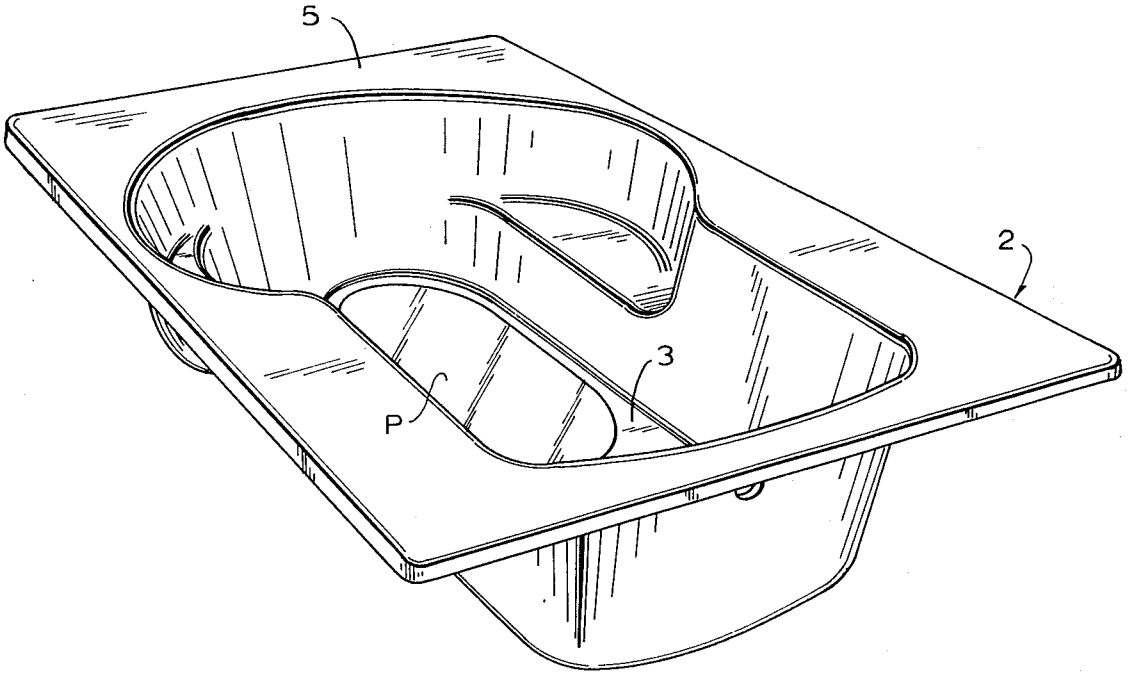
FIG. 1 is a perspective view as seen from the top and one end of a bathtub embodying our new design.
Figure 2:
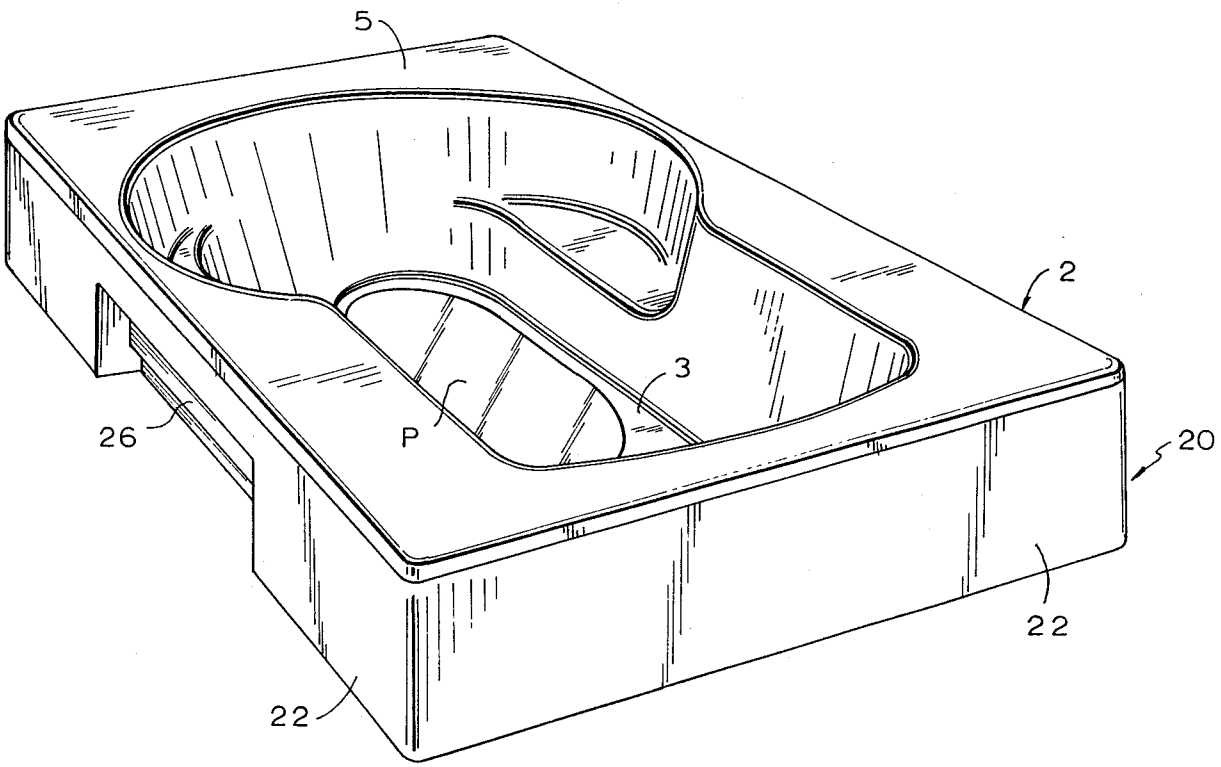
FIG. 2 is a view similar to FIG. 1 showing the bathtub assembled with its support structure.
Figure 3:
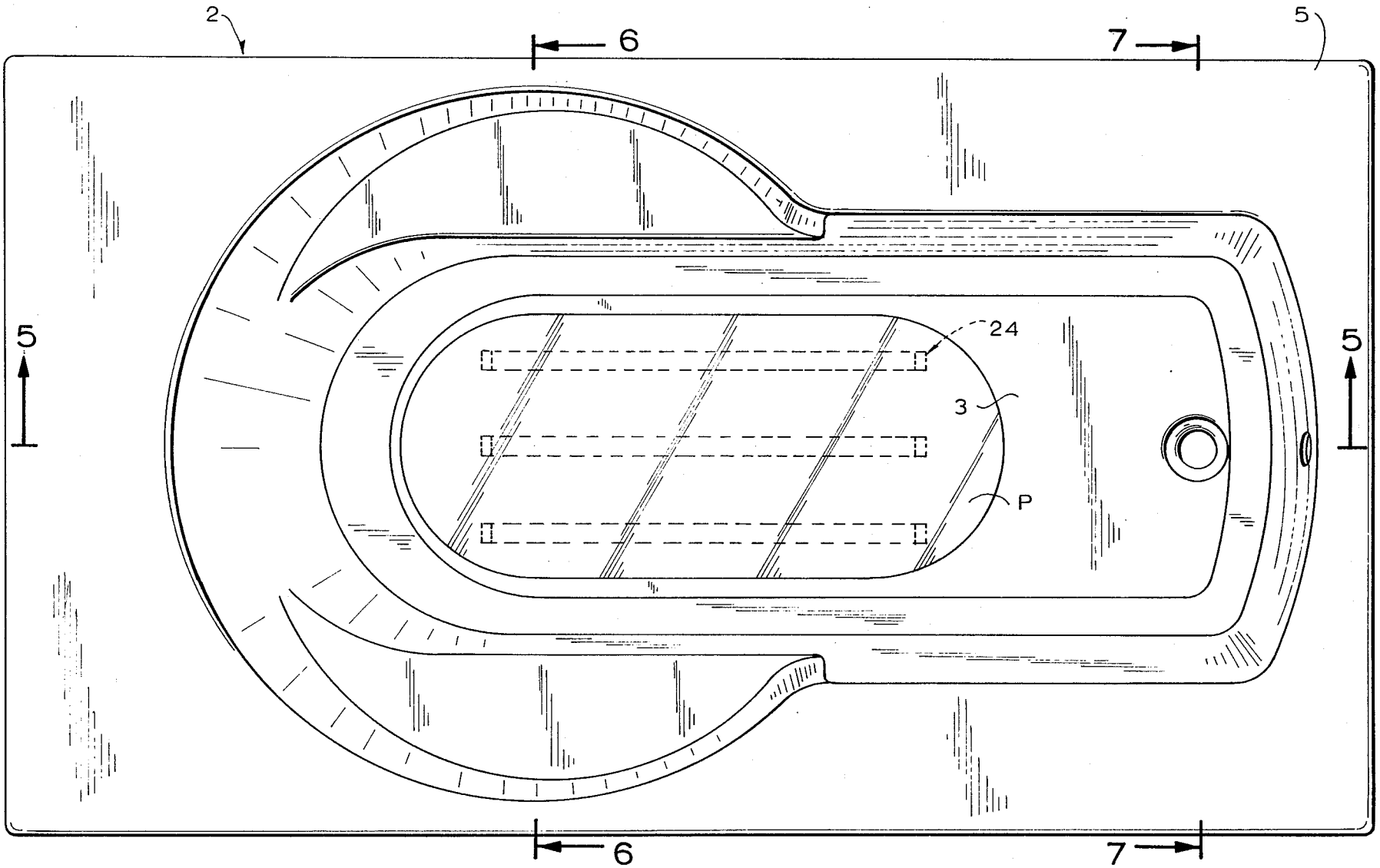
FIG. 3 is a top plan view of a bathtub of FIG. 2.
Figure 4:
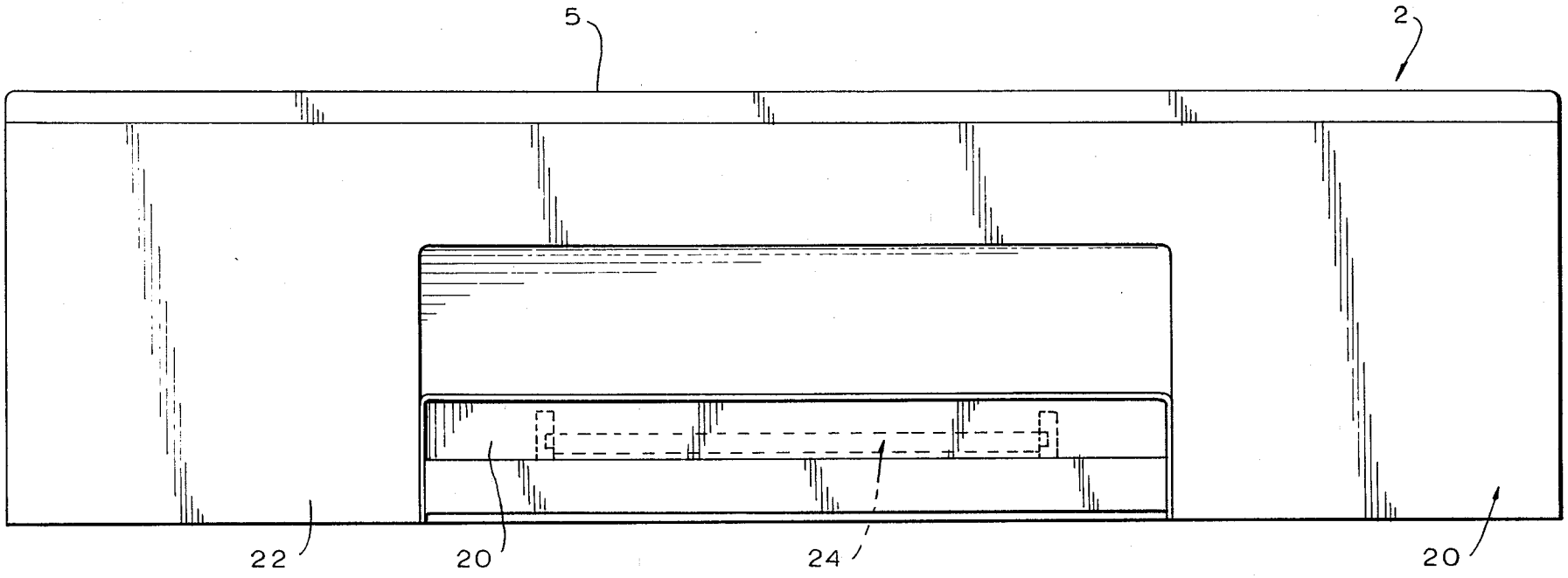
FIG. 4 is a side elevational view of the bathtub shown in plan in FIG. 3.
Figure 5:
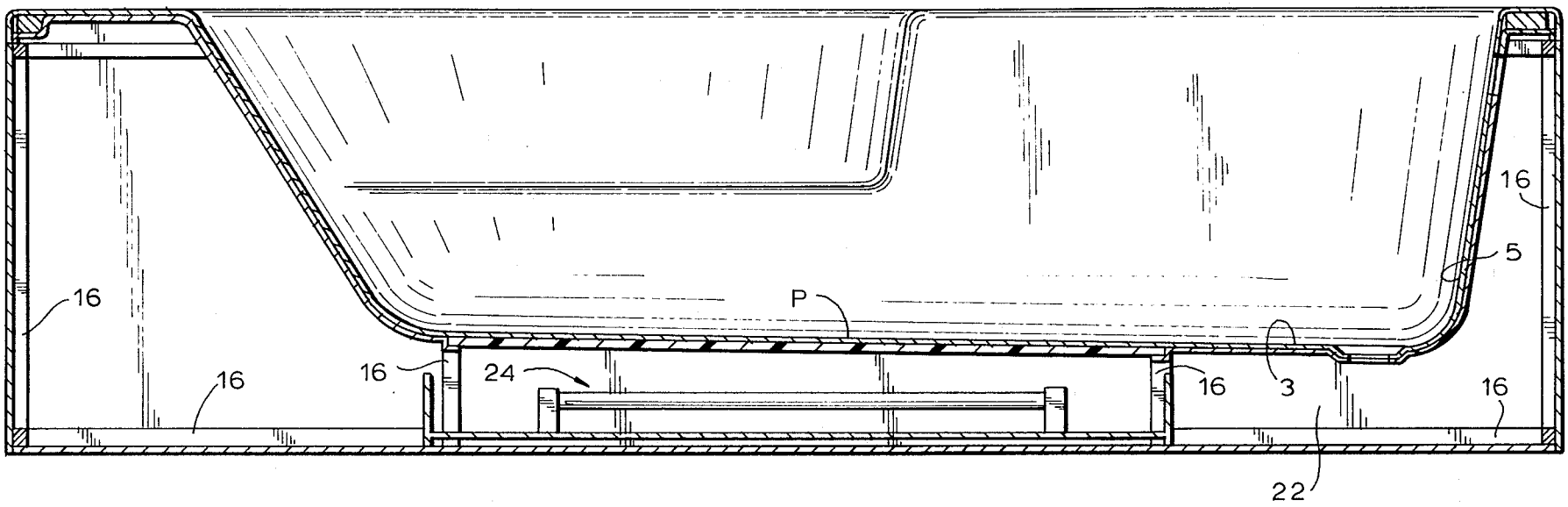
FIG. 5 is a sectional view, in elevation, taken along the lines 5—5 of FIG. 3.
Figure 6:
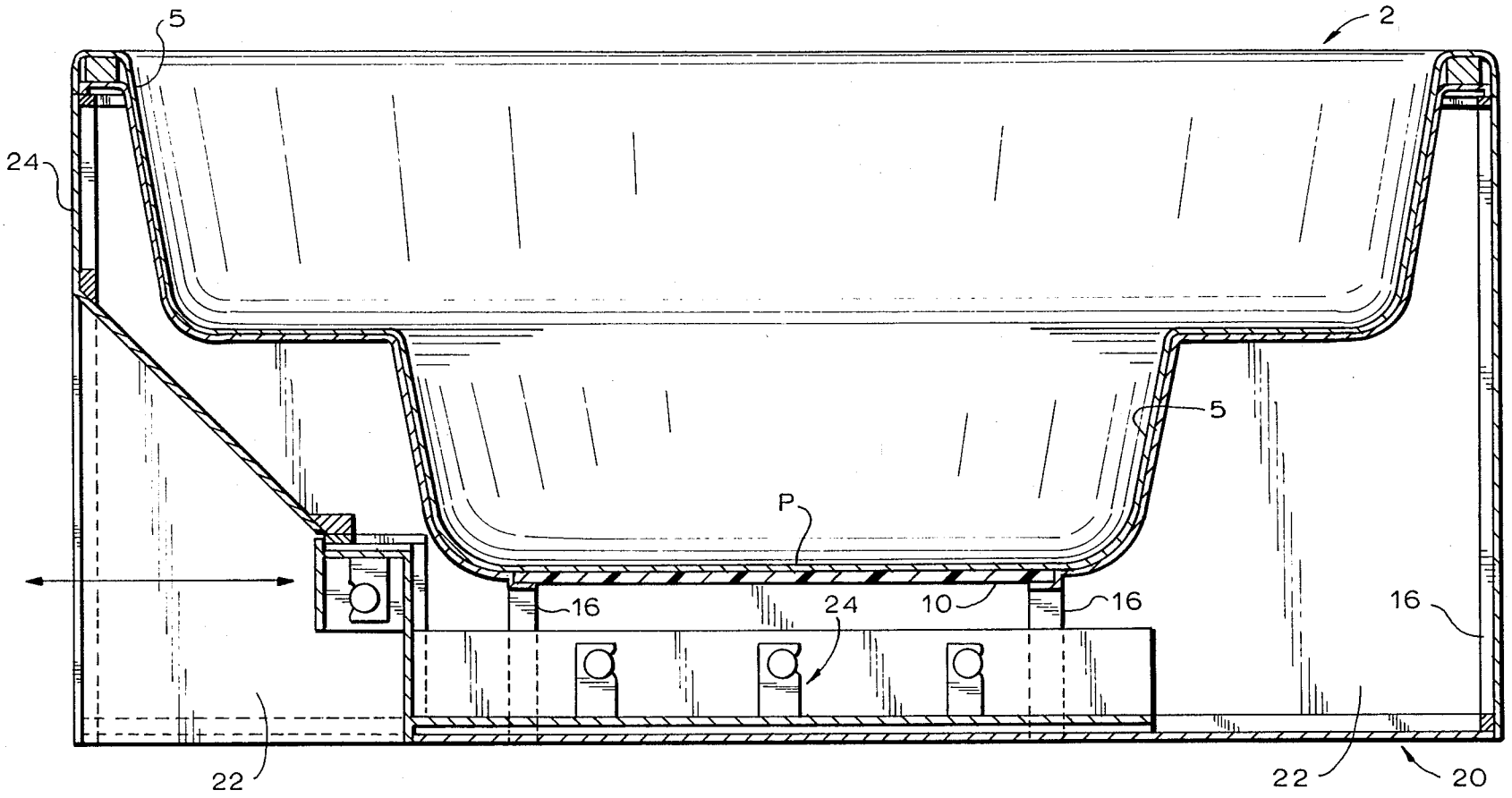
FIG. 6 is a sectional view, in elevation, taken along the lines 6—6 of FIG. 3.
Figure 7:
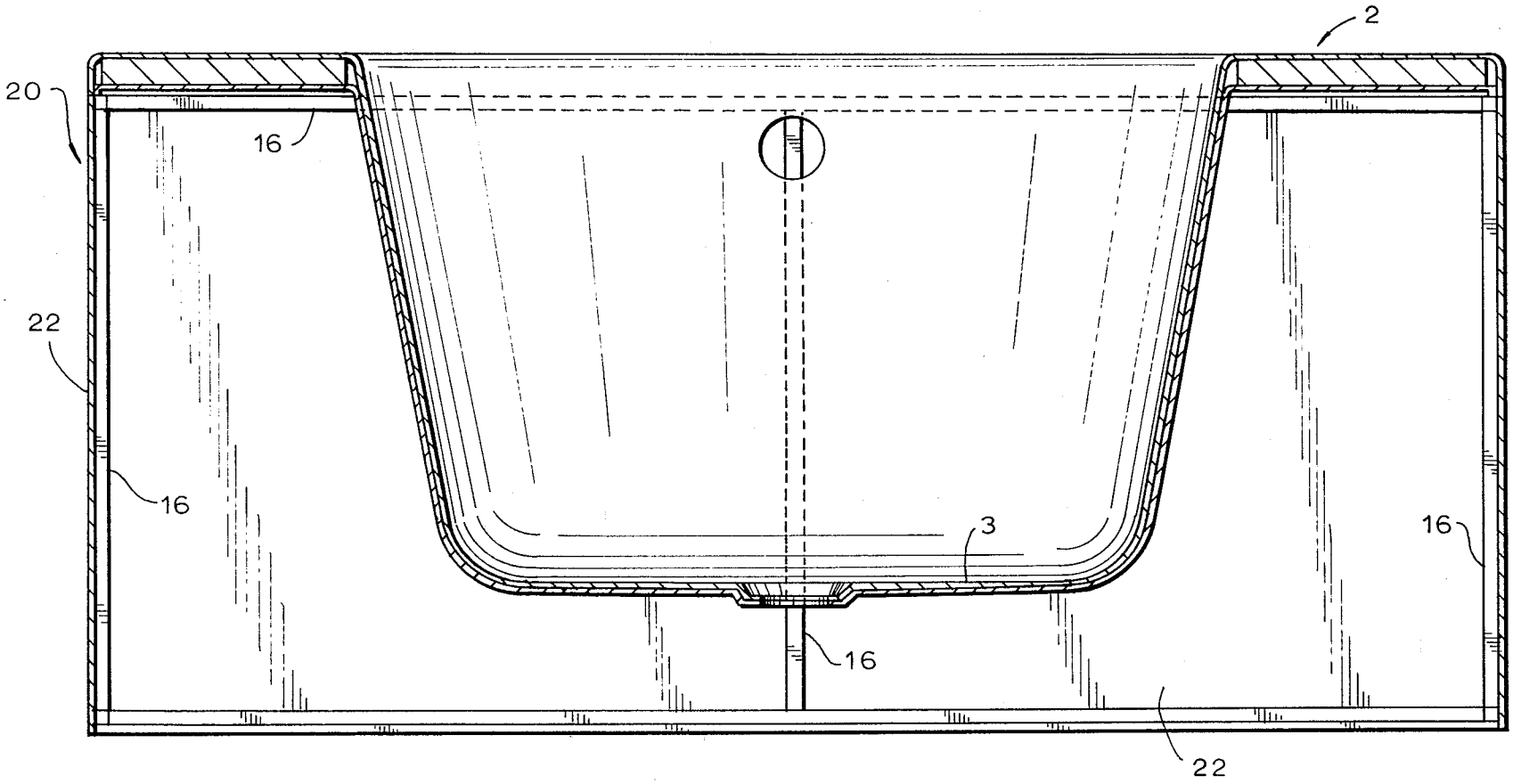
FIG. 7 is a sectional view, in elevation, taken along the lines 7—7 of FIG. 3.

The feature of this embodiment, in accordance with the invention, is that by vacuum-forming the bath from a translucent sheet of material, light diffuser grade PERSPEX (polymethacrylate) made by Imperial Chemical Industries, and then applying suitable masks, it will be possible to transmit light through various panels in the bath itself from lighting tubes hidden underneath.

In particular, the design allows for light to be transmitted through the base or bottom wall of the bath sump, probably the most difficlt area since the base is normally supported by wooden boards which are, of course, opaque. In this case, a technique is proposed for supporting the base, using a slab of a clear plastic acrylic, such as an acrylic panel, and the ultimate construction of the bath base is illustrated in the drawings.

First of all, the translucent shell 5, which has been vacuum-formed, has a removable mask, not shown, applied to it to mask off an area P intended to transmit light. The remaining shell is then sprayed with a paint-like material 7, which itself forms a permanent masking over the remainder of the shell. Bath shell 5 is of the type used for sunken or island installations and requires a suitable support structure 20 to house bathtub assembly 2.

Any suitable paint or sprayed-on or brushed-on coating may be used for the permanent masking.

In this case, the paint layer 7 will be colored white but it could, obviously, be any color. This paint-like material 7 has the effect of reflecting light through the translucent opal shell, thus changing its color somewhat. When white is used, the opal sheets ends up looking almost like normal white acrylic sheets.

The removable mask is then removed from light-transmitting area P, leaving a window in the paint through which diffused light can pass.

A slab panel 10 of clear acrylic is then bonded to the base of the bath, such that it overhangs perimeter 8 of light-transmitting area P, using a clear two-pack acrylic cement 11 which has been mixed and previously degassed to remove air bubbles. The cement 11, while desirable, may not be essential. It has the effect of avoiding undesirable optical effects occuring between acrylic panel 10 and light-transmitting area P of shell 5, but it is conceivable that such effects could be avoided by other means, or even retained to provide a decorative effect.

Figure 8:
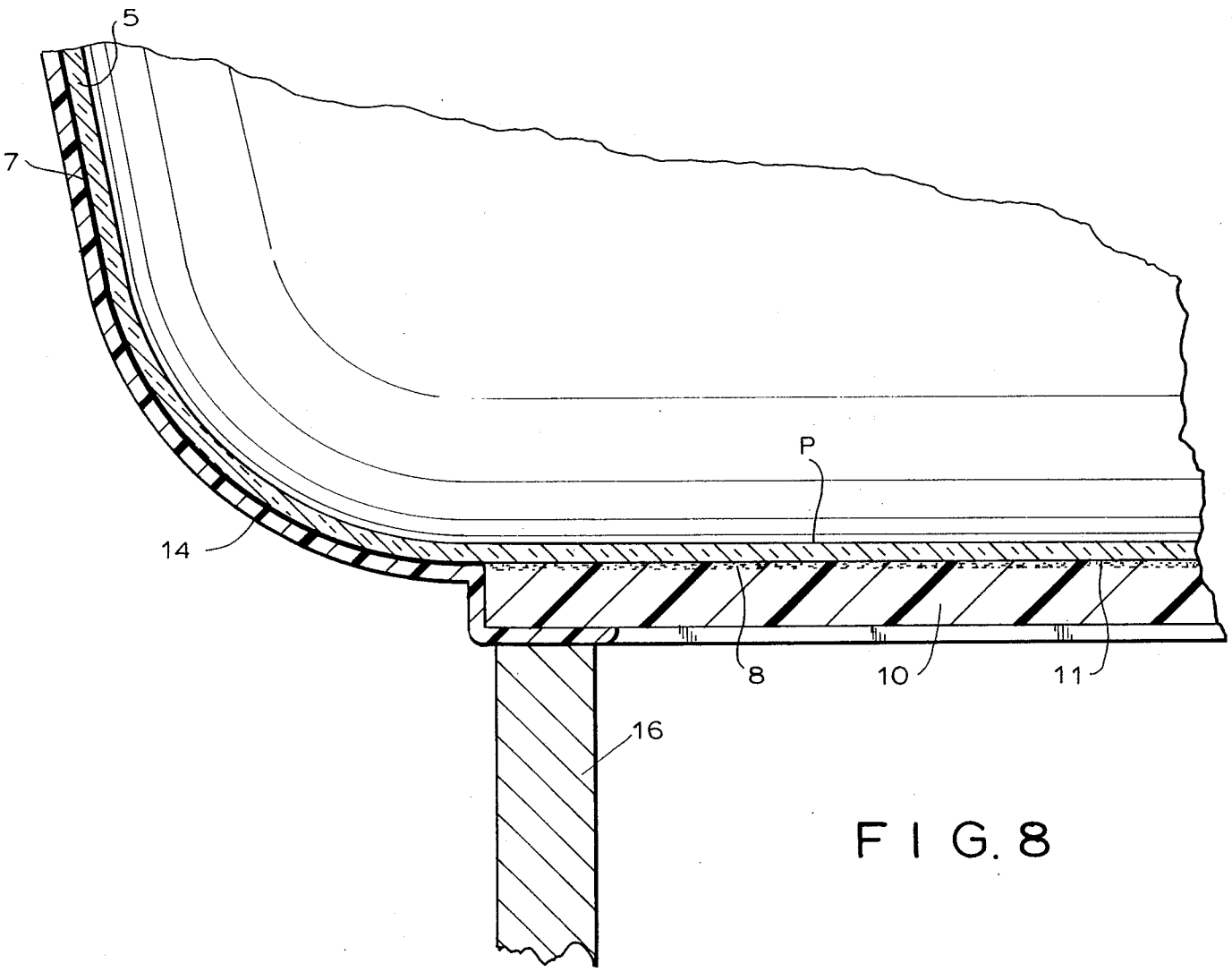
FIG. 8 is an enlarged fragmentary sectional view of a portion of the sump, illustrating the light-transmitting area and having a transparent or translucent panel mounted thereto.

Finally, shell 5, with the exception of clear light-transmitting area P and acrylic panel 10, is backed with glass-reinforced plastic 14. The bottom wall of bathtub 2 is then supported by longitudinal beams 16 positioned under the edge of acrylic panel 10, shown in FIG. 8.

Obviously, windows such as these could be located anywhere on a wall of the bathtub, but under the bottom wall they present special problems due to the base support requirement.

On the sides of the bath sump, it may be possible to produce this effect without bonding a clear acrylic panel over the surface or, perhaps, only a thin, clear acrylic sheet would have to be bonded locally There are alternative ways of supporting the bottom wall and reinforcing the light-transmitting panel, and one of these would be to fiberglass the whole underside of shell 5, using a resin and glass system where the subsequent laminate has high light-transmission properties similar to the glass-reinforced plastic system normally used for light-transmitting roof sheeting. Still another method may be to shape the bath from an even thicker acrylic sheet in the first place.

Figure 9:
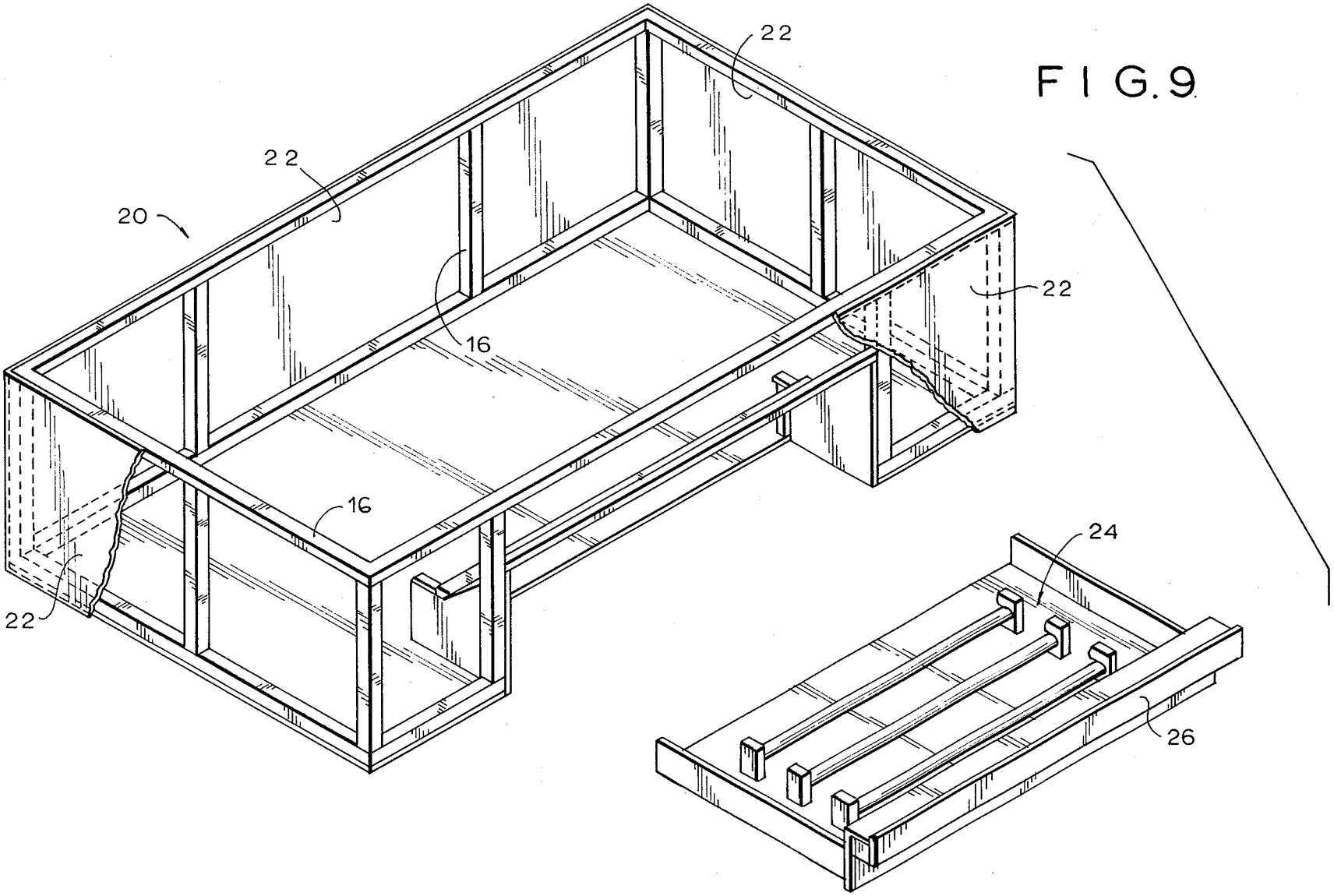
FIG. 9 is an exploded perspective view of the support structure of FIG. 2.
Figure 10:
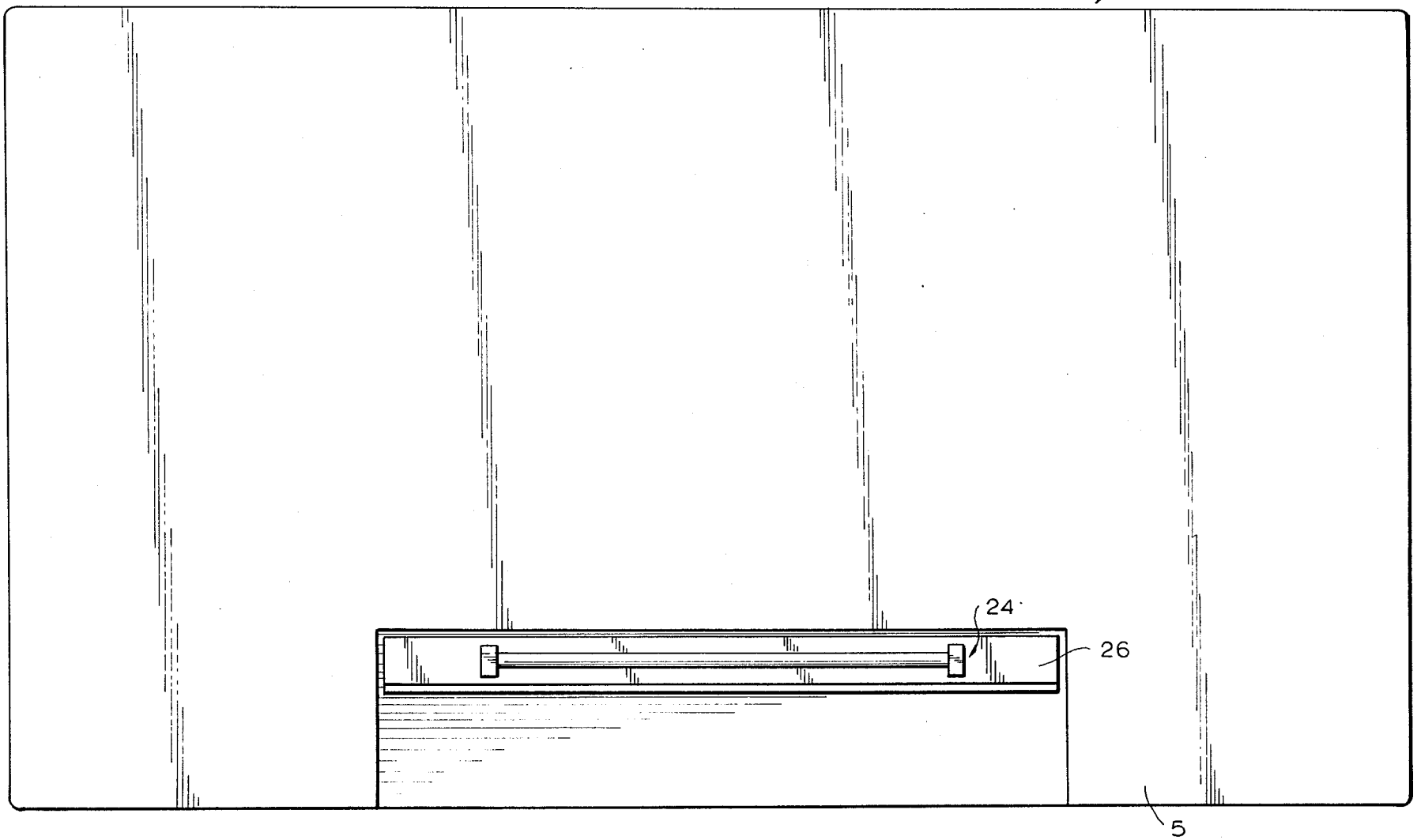
FIG. 10 is a bottom plan view of FIG. 3.

Support structure 20, shown in FIGS. 2, 4–7, 9 and 10, illustrates a so-called island structure for housing bathtub 2. Support structure 20 includes vertical and horizontal support members, generally in the form of wood studs 16. Studs 16 are covered by wood panels 22, which may be the finished surface or could support a covering of choice. A fluorescent fixture 24, electrically connected to a power source, not shown, mounted in a removable tray 26, is slideably received in support structure 20, as shown in FIG. 9. When positioned under light-transmitting area P, shown in FIGS. 5 and 6, a source of light energy is provided to illuminate acrylic panel 10 and area P so that light will illuminate the water when the bathtub is in use.

The invention is, as mentioned, not limited to bathtubs, but could be applied to almost any other molded plastic sanitaryware article such as a shower tray, wash basin or pedestal, or a component such as a bath side panel. When incorporated in the bath itself, the light-transmitting area or areas could be in the top surface, i.e. the surround or roll, as it is called.

While the area of light-transmitting characteristic, as described above, would have a fairly well defined edge, not necessarily a sharp edge, since parallax makes the edge appear less apparent, it could be arranged that the area of light-transmitting property gradually becomes denser to light so that it merges or fades into the opaque region(s). This could be arranged in various ways, such as by varying the thickness of the permanent masking paint 7 at the edge region 8, or by applying another mask over that region, or having a suitable overlying panel 10 which is less light-translucent around its edges.

Naturally, the area or areas of light-transparancy or light-translucency may be of any shape and, if more than one, they may be continuous or discontinuous and/or in a particular pattern. The area or areas may be in regions where the surface is generally planar, as in the cases of a bath or shower tray base wall or bottom, or a bath side wall, or a bath side or end panel fitting between the bath roll and the floor, or where the surface is curved in one plane, such as a wash basin pedestal or bath end wall, or where the surface is concave or convex in two planes.

In installation as shown in the drawings, lighting tubes could be placed directly underneath the acrylic base panel 10, or to one side, to produce the desire lighting effect.

It is claimed:

1. A method for making a molded article of sanitaryware comprising:

providing a sheet of light-transmitting plastic material and forming said material on a mold to produce a molded unreinforced shell in the shape of an article of sanitaryware of the type having a sump which is defined by side walls and a bottom wall having a drain opening therein;

applying a mask to at least a portion of one of said walls of said shell intended, in the finished article, to form a light-transmitting area;

coating the remaining shell area to make it effectively opaque; and removing said mask to provide said at least one light-transmitting area and bonding a rigid panel of a light-transmitting plastic material in overlying relation to the outer surface of said light-transmitting area of said shell, thereby forming a support for said area.

2. The method of claim 1, including applying a reinforcement layer of plastic material to said opaque area of said shell.

3. The method of claim 2, including applying said reinforcement layer of plastic material in surrounding relation to the edges of said panel of said light-transmitting area.

4. The method of claim 1 wherein said mask covers at least a portion of said bottom wall of said shell.

5. The method of claim 4 wherein said shell is in the form of a bathing vessel.

6. The method of claim 1 wherein said plastic sheet material is acrylic.

7. The method of claim 1 wherein said plastic sheet material is vacuum-formed.

* * * * *